US006546306B1

(12) United States Patent
Bushman et al.

(10) Patent No.: US 6,546,306 B1
(45) Date of Patent: Apr. 8, 2003

(54) METHOD FOR ADJUSTING INCOMING FILM THICKNESS UNIFORMITY SUCH THAT VARIATIONS ACROSS THE FILM AFTER POLISHING MINIMIZED

(75) Inventors: Scott Bushman, Austin, TX (US); William Jarrett Campbell, Austin, TX (US)

(73) Assignee: Advanced Micro Devices, Inc., Austin, TX (US)

( * ) Notice: Subject to any disclaimer, the term of this patent is extended or adjusted under 35 U.S.C. 154(b) by 0 days.

(21) Appl. No.: 09/371,635

(22) Filed: Aug. 11, 1999

(51) Int. Cl.[7] ..... G06F 19/00

(52) U.S. Cl. ..... 700/121; 700/117; 700/120; 700/150; 700/157; 700/155; 700/160; 438/624; 438/632; 438/690; 438/763; 451/8; 451/10; 451/22; 451/41

(58) Field of Search ..... 700/117, 120, 700/121, 108, 150, 155–157, 160, 164, 175; 438/624, 672, 690, 691–692, 669, 633–634, 476, 763; 451/8, 41, 56, 10, 22, 63, 288, 203

(56) References Cited

U.S. PATENT DOCUMENTS 5,851,846 A * 12/1998 Matsui et al. ..... 216/52
6,135,859 A * 10/2000 Tietz ..... 451/303
6,150,274 A * 11/2000 Liou et al. ..... 438/623
6,151,532 A * 11/2000 Barone et al. ..... 204/192.13
6,179,709 B1 * 1/2001 Redeker et al. ..... 451/168
6,213,848 B1 * 4/2001 Campbell et al. ..... 451/41
6,230,069 B1 * 5/2001 Campbell et al. ..... 700/121
6,265,314 B1 * 7/2001 Black et al. ..... 438/690

* cited by examiner

*Primary Examiner*—Ramesh Patel
(74) *Attorney, Agent, or Firm*—Williams, Morgan & Amerson, P.C.

(57) ABSTRACT

A method comprising determining a polishing profile produced by a polishing tool and manufacturing a process layer with a surface profile prior to polishing operations based upon the determined polishing profile of the polishing tool.

22 Claims, 8 Drawing Sheets

METHOD FOR ADJUSTING INCOMING FILM THICKNESS UNIFORMITY SUCH THAT VARIATIONS ACROSS THE FILM AFTER POLISHING MINIMIZED

BACKGROUND OF THE INVENTION

1. Field of the Invention

The present invention is generally related to the field of semiconductor processing, and, more particularly, to polishing operations in semiconductor processing operations.

2. Description of the Related Art

Chemical mechanical polishing ("CMP") is widely used in semiconductor processing operations as a means of planarizing various process layers, e.g., silicon dioxide, formed above a wafer comprised of a semiconducting material, such as silicon. Chemical mechanical polishing operations typically employ an abrasive slurry distributed in an alkaline or acidic solution to planarize the surface of a process layer through a combination of mechanical and chemical actions.

The continual drive to reduce feature sizes, e.g., channel length, on semiconductor devices has increased the importance of chemical mechanical polishing or planarization in the semiconductor fabrication process. For example, as feature sizes tend to decrease, the depth of field of photolithography equipment tends to shrink, thereby necessitating a very flat or planar surface so that very small dimensions may be accurately patterned on a wafer. Additionally, there has been, and continues to be, a constant drive to increase the productivity of fabrication techniques employed in making modern semiconductor devices. In short, there is a constant drive within the industry to make the same high-quality semiconductor products, but to do it faster, better, and in a less expensive manner.

FIG. 1 is a schematic drawing of one illustrative embodiment of a chemical mechanical polishing tool used in semiconductor processing operations. As depicted therein, the illustrative polishing tool 10 is comprised of a rotatable table 12 on which an illustrative polishing pad 14 is mounted, and a multi-head carrier 16 positioned above the pad 14. The multi-head carrier 16 includes a plurality of rotatable polishing arms 18, each of which includes a carrier head 20. Typically, wafers (not shown) are secured to the carrier heads 20 by the use of vacuum pressure. This is sometimes referred to as the carrier backforce pressure. In use, the table 12 is rotated and an abrasive slurry is dispensed onto the polishing pad 14. Once the slurry has been applied to the polishing pad 14, a downforce is applied to each rotating polishing arm 18 to press its respective wafer against the polishing pad 14. As the wafer is pressed against the polishing pad 14, the surface of the process layer on the wafer is mechanically and chemically polished. Although the tool depicted in FIG. is a multi-head polishing tool 10, similar single-head type machines exist in the industry, and the present invention is not limited to any particular embodiment, form or structure of a tool that may be used to perform chemical mechanical polishing operations.

In general, wafers are polished according to various polishing recipes that may vary, depending upon a variety of factors, e.g., the type of material being polished, the desired rate of removal of the product, etc. Ideally, after polishing operations are performed, the surface of a process layer will be precisely planar. However, in the practice, this ideal situation may not be attained. For example, as shown in FIG. 2, a surface 31 of a process layer 32 formed above a semiconducting substrate 30 may be convex, i.e., bulged in the middle area of the process layer. This domed-type topography is often referred to as a center-slow or edge-fast polishing profile because the center region 15 of the process layer 32 polishes at a slower rate than the edge region 17 of the process layer 32. Alternatively, after some polishing operations, as shown in FIG. 3, a surface 33 of a process layer 32 formed above a semiconducting substrate 30 may be concave, i.e., dished at the center region of the process layer. This situation is sometimes referred to as a center-fast or edge-slow polishing profile. This occurs when the polishing rate at the center region 15 of the process layer 32 is greater than the polishing rate at the edge region 17 of the process layer 32.

Such illustrative variations across a surface of a process layer after polishing operations may be due, in part, to the inherent nature of polishing operations. Moreover, the variations may be combined, i.e., convex surfaces in given areas and concave surfaces in others across the surface of the wafer. Simply put, after traditional polishing operations, the surface of the process layer is not as uniform as would otherwise be desired for efficient processing operations.

The present invention is directed to a method of solving, or at least reducing, some or all of the aforementioned problems.

SUMMARY OF THE INVENTION

The present invention is directed to a method for compensating for thickness variations in process layers subjected to planarization operations. In one illustrative embodiment, the method comprises determining a polishing profile produced by a polishing tool and manufacturing a process layer with a surface profile prior to polishing operations based upon the determined polishing profile of the polishing tool. In another illustrative embodiment, the method comprises determining variations in the thickness of a first process layer after polishing operations are performed on the first process layer, and varying the manufactured thickness of a second process layer prior to performing polishing operations on the second process layer. the manufactured thickness of the second process layer being based upon the determined thickness variations in the first process layer.

BRIEF DESCRIPTION OF THE DRAWINGS

The invention may be understood by reference to the following description taken in conjunction with the accompanying drawings, in which like reference numerals identify like elements, and in which.

Figure 1:
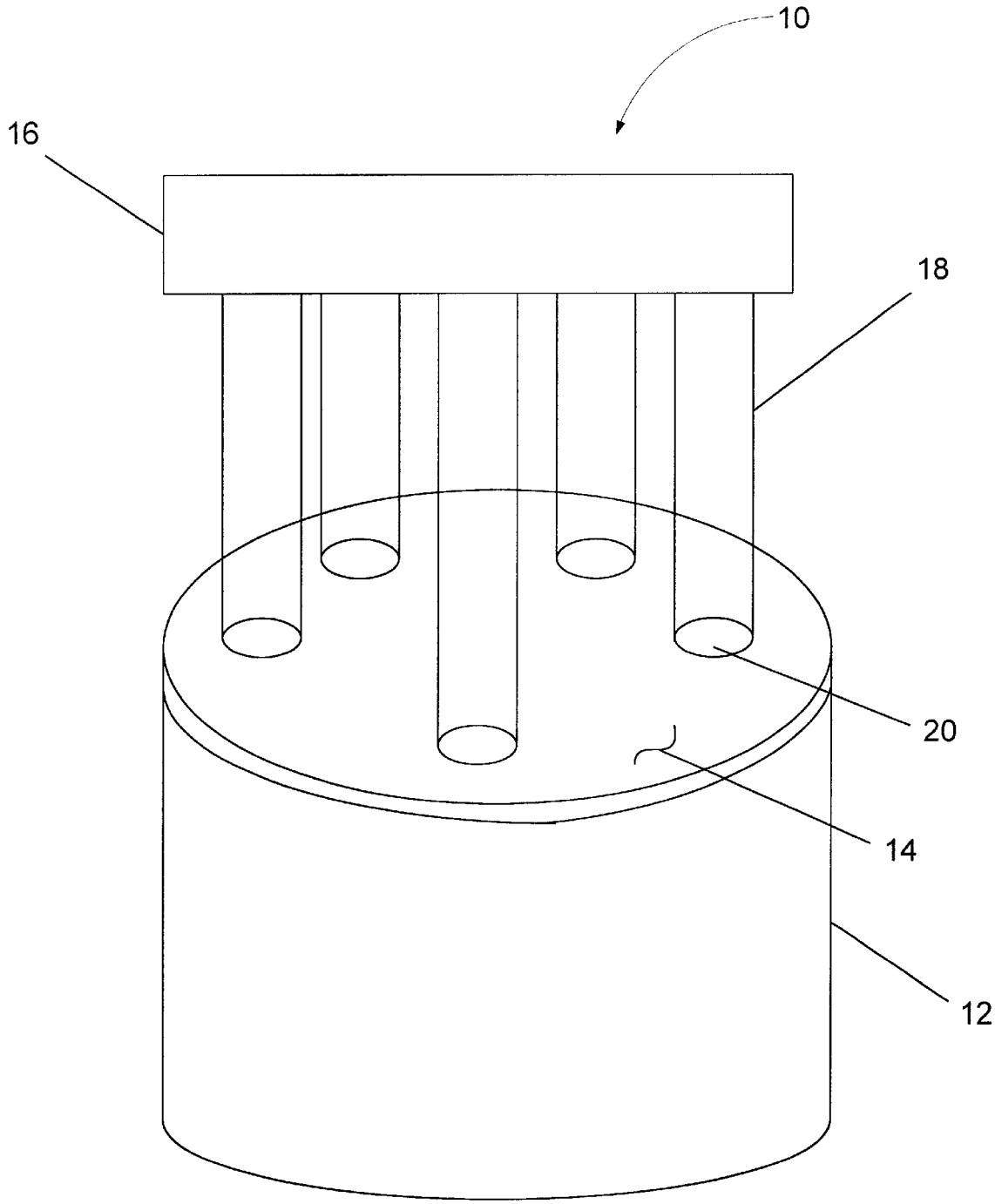
FIG. 1 (Prior Art)
FIG. 1 is a schematic drawing of an illustrative polishing tool.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to FIGS. 4–10. The relative sizes of the various features depicted in the drawings may be exaggerated or reduced as compared to the size of those features in actual semiconductor devices and/or processing tools. Nevertheless, the attached drawings are included to describe and explain illustrative examples of the present invention.

In general, the present invention is directed to a method for reducing thickness variations in process layers after polishing operations. As will be readily apparent to those skilled in the art upon a complete reading of the present application, the present method is applicable to a variety of technologies, e.g., NMOS, PMOS, CMOS, etc., a variety of devices, including, but not limited to, logic devices, memory devices, etc., and a variety of process layers, e.g., insulating layers, metal layers, polysilicon layers, etc.

Figure 4A:
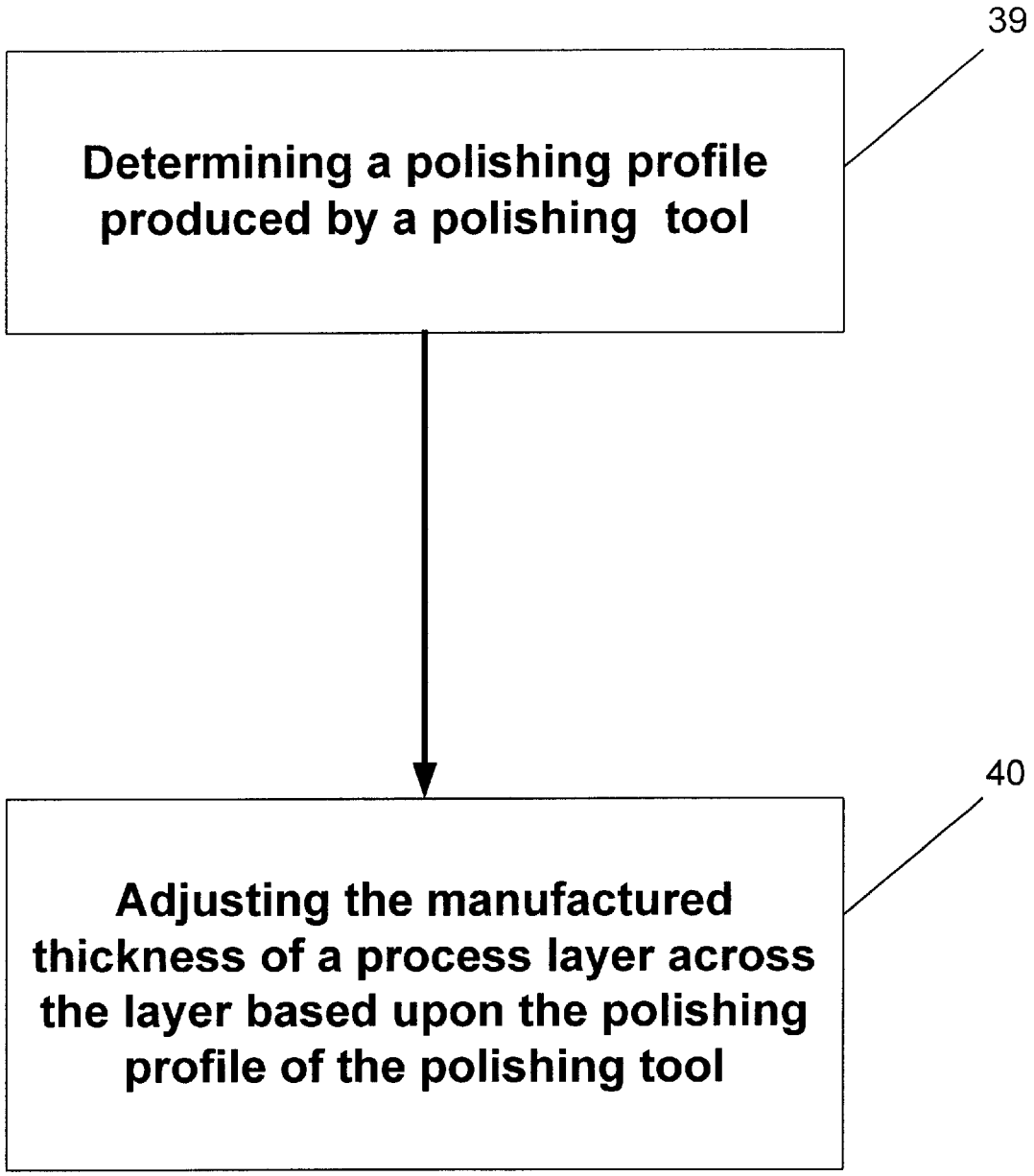
FIG. 4A is a flowchart depicting one illustrative embodiment of the present invention.

A flowchart depicting one illustrative embodiment of the present invention is depicted in FIG. 4A. As indicated at block 39, the method disclosed herein initially comprises determining a polishing profile produced by a polishing tool. Thereafter. the method comprises adjusting the manufactured thickness of a process layer (prior to polishing operations) based upon the determined profile of the polishing tool, as indicated at block 40.

The polishing profile produced by a polishing tool may vary depending upon a number of factors. For example, the profile produced by the tool, e.g., a concave or convex surface, may depend upon the type of tool involved, the age or extent of glazing of the polishing pad used on the tool, the type of material being polished, or simply the inherent nature of the tool. Irrespective of the causes of such polishing profiles, the profile, and its magnitude, are initially determined, as indicated at block 39. By way of example, a statistically adequate number of measurements may be made using an ellipsometer, or other metrology tool, to determine the variations in the surface of the process layer after polishing as compared to a true planar surface.

Figure 3:
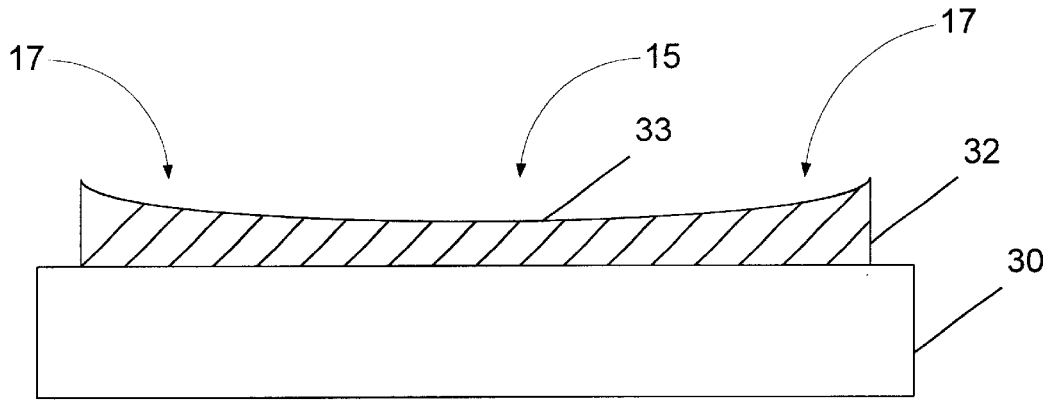
(Prior Art) FIG. 3
FIG. 3 is yet another illustrative example of a process layer after prior art polishing operations have been performed thereon.

Thereafter, as indicated at block 40, the manufactured thickness of a process layer to be polished is adjusted based upon the polishing profile determined at block 39. For example, if it is determined that the polishing profile of the polishing tool results in a concave or dished surface (see, e.g., surface 33 of FIG. 3), then the manufactured thickness of a process layer to be polished is adjusted to at least partially compensate for the polishing profile normally produced by the polishing tool, i.e., the process layer may be made thicker in the middle region of the layer. In this manner, the present invention provides for more planar process layers after polishing operations are performed.

As will be readily apparent to those skilled in the art upon a complete reading of the present invention, the present invention may be employed with process layers comprised of a variety of materials, e.g., silicon dioxide, other insulating materials, metal layers, etc. Moreover, the present invention is not limited to any particular technique or method of forming the process layers described herein, e.g., deposition, thermal growing, etc., are all acceptable techniques for producing process layers that have a manufactured thickness that is based upon the determined profile of the polishing tool.

Figure 4B:
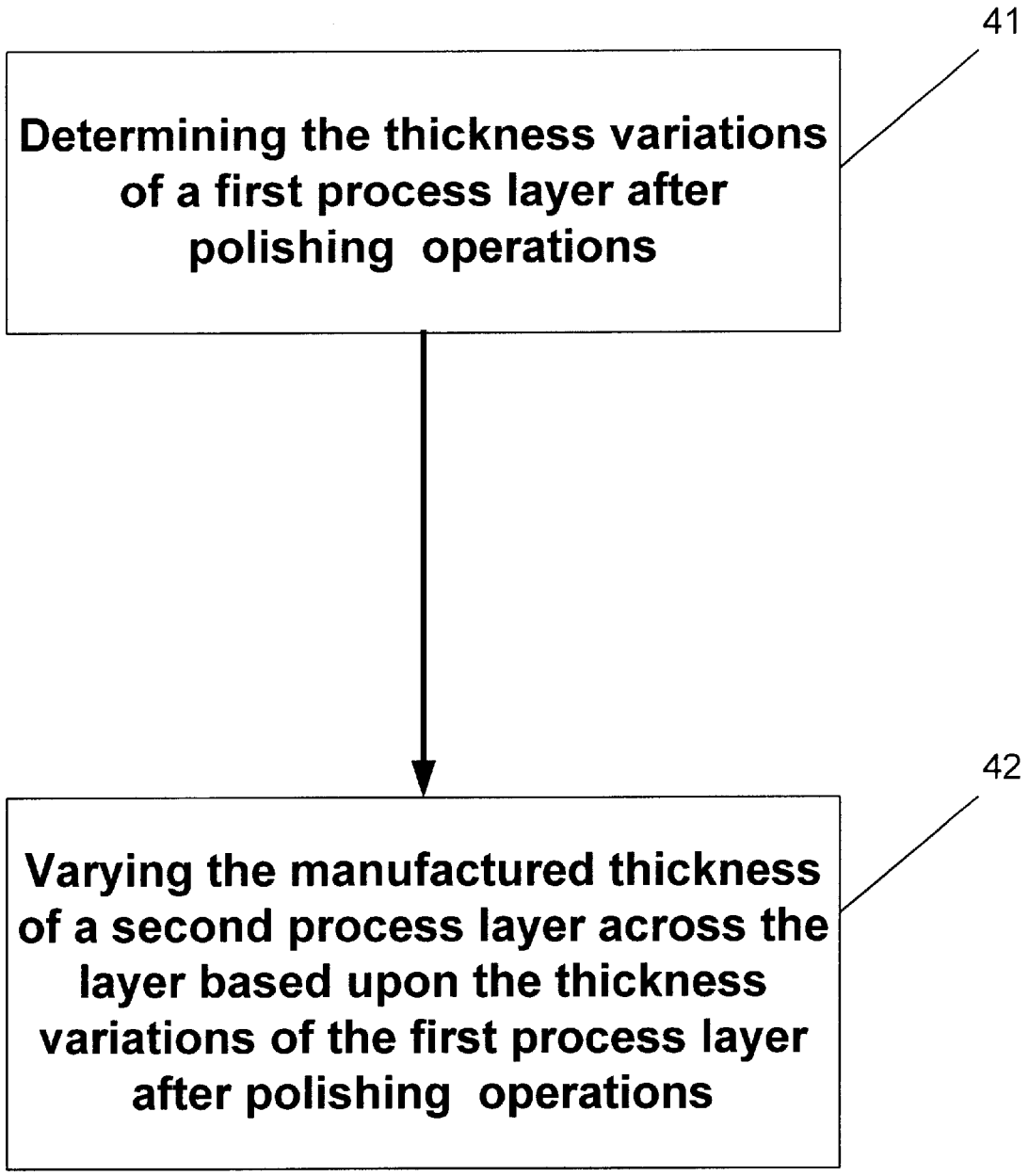
FIG. 4B is another flowchart depicting yet another illustrative embodiment of the present invention.

A flowchart depicting another illustrative embodiment of the present invention is shown in FIG. 4B. As shown therein, the method generally comprises determining the thickness variations across a first process layer after polishing operations, as indicated at block 41, and varying the manufactured thickness of a second process layer prior to polishing operations based upon the thickness variations of the first process layer after polishing operations, as indicated at block 42. The thickness variations may be determined by an ellipsometer or other similar metrology tool. The number and location of measurements are all matters of design choice. However, more measurements often corresponds to a more accurate thickness profile of the process layer. As with the embodiment depicted in FIG. 4A, one purpose of the method shown in FIG. 4B is to provide information such that a process layer yet to be polished may be formed so as to have local thickness variations that will compensate for the thickness variations caused by the polishing tool.

Figure 5:
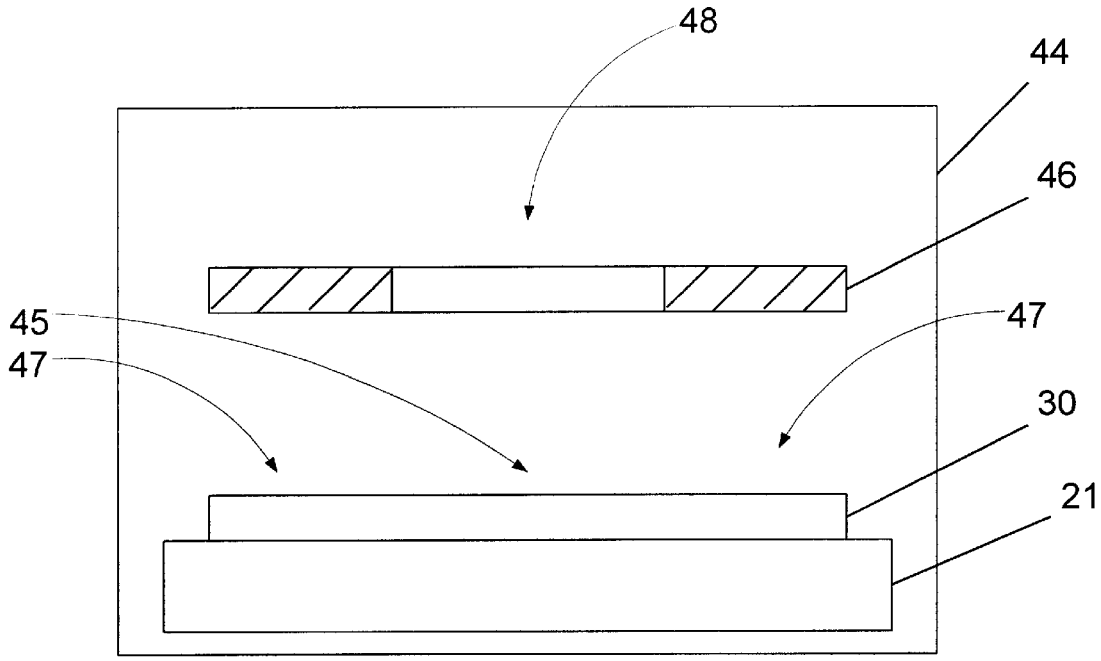
FIG. 5 is a partial, cross-sectional view of an illustrative embodiment of a processing tool that may be used with the present invention.
Figure 6:
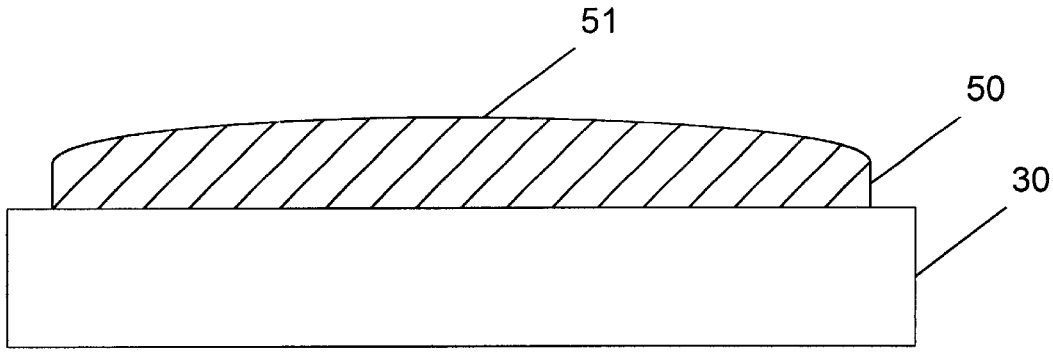
FIG. 6 is a partial, cross-sectional view of an illustrative embodiment of a wafer made in accordance with one aspect of the present invention.

One apparatus useful in carrying out the present invention is depicted in FIG. 5. As shown therein, an illustrative wafer 30 is positioned on a pedestal 21 in an illustrative deposition tool 44. A baffle 46 is positioned above the wafer 30 in the deposition tool 44 so as to selectively increase the thickness of a process layer (not shown in FIG. 5) formed on the wafer 30. In the illustrative embodiment depicted in FIG. 5, the baffle 46 is generally circular in shape with an opening 48 formed in the middle thereof. Using this technique, deposition rates in a middle region 45 of the wafer 20 may be increased relative to deposition rates toward edge regions 47 of the wafer 20 due to differences in partial pressure in these regions. As a result of employing the apparatus shown in FIG. 5, a process layer 50 having a convex surface 51 may be formed above the wafer 30, as shown in FIG. 6. Thereafter, when the process layer 50 is subjected to polishing operations with the chemical mechanical polishing tool that normally produces a process layer having a concave surface, as indicated by the surface 33 in FIG. 3, the resulting process layer, after polishing operations, will be more planar than would otherwise be attainable using traditional chemical mechanical polishing operations that fail to account for variations produced by the polishing tool.

Figure 2:
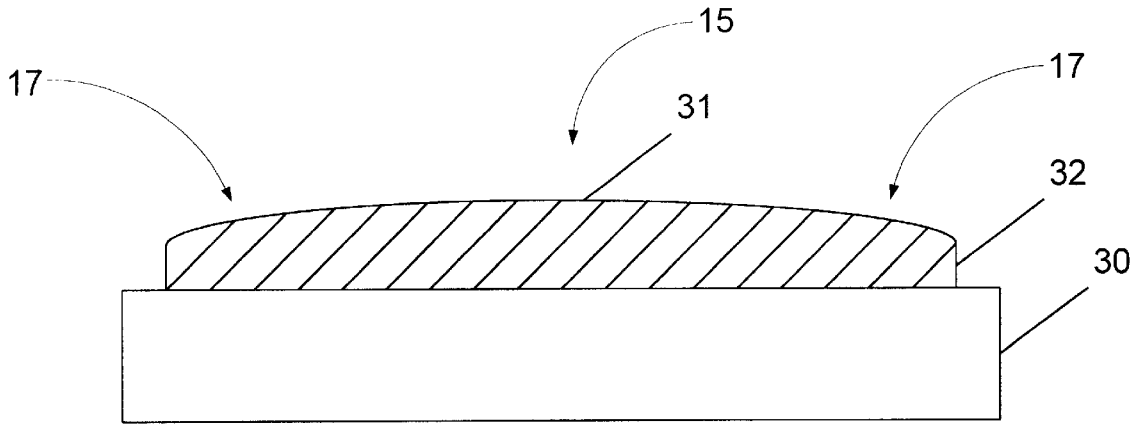
(Prior Art) FIG. 2
FIG. 2 is an illustrative example of a process layer after prior art polishing operations have been performed thereon.
Figure 7:
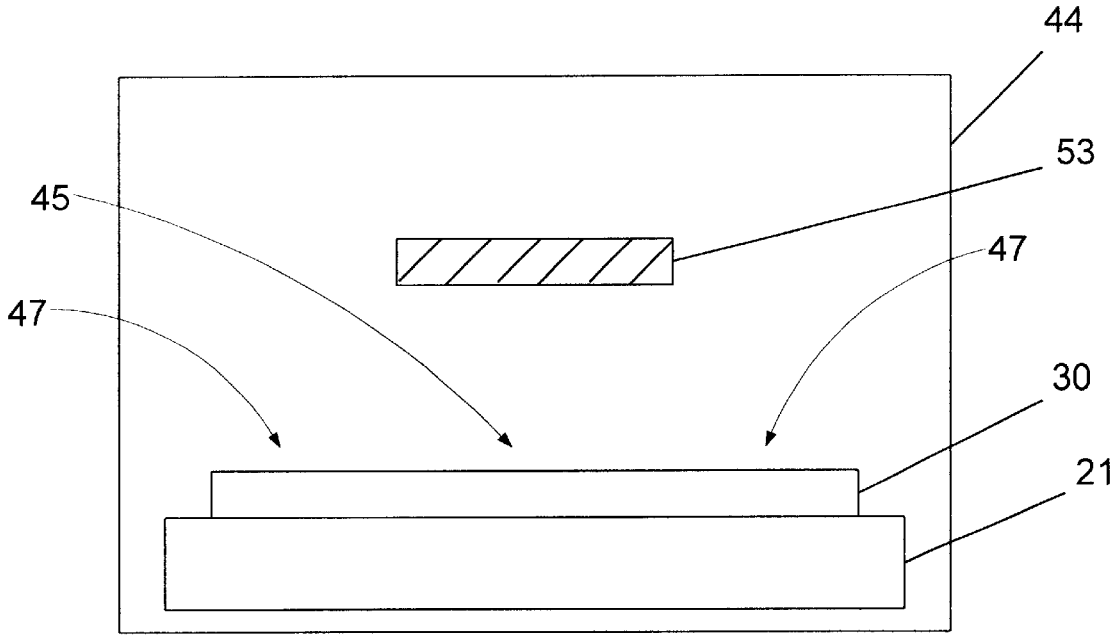
FIG. 7 is a partial, cross-sectional view of yet another illustrative embodiment of a processing tool that may be used with the present invention.
Figure 8:
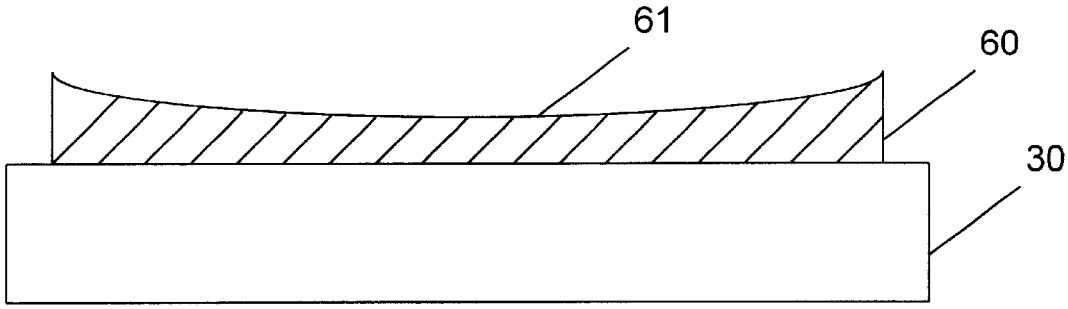
FIG. 8 is a partial, cross-sectional view of yet another illustrative embodiment of a wafer made in accordance with another aspect of the present invention.

Yet another embodiment of an illustrative processing tool that may be used with the present invention is shown in FIG. 7. As shown therein, the illustrative wafer 30 is positioned on the pedestal 21 in the illustrative deposition tool 44. A baffle 53 is positioned in the deposition tool 44 so as to selectively increase the thickness of the process layer (not shown in FIG. 7) formed on the wafer 30. In the illustrative embodiment depicted in FIG. 7, the baffle 53 is generally circular in shape and positioned above the approximate middle region 45 of the wafer 30. Using this technique, deposition rates at the edge regions 47 of the wafer 30 may be increased relative to the deposition rates in the middle region 45 of the wafer 30 due to differences in partial pressure. As a result of employing the apparatus shown in FIG. 7, a process layer 60 having a concave surface 61 may be formed above the wafer 30, as shown in FIG. 8. Thereafter, when the process layer 60 is subjected to polishing operations with the chemical mechanical polishing tool that normally produces a process layer having a convex surface, as indicated by the surface 31 in FIG. 2, the resulting process layer should be more planar than would otherwise be attainable using traditional chemical mechanical polishing operations.

Figure 9:
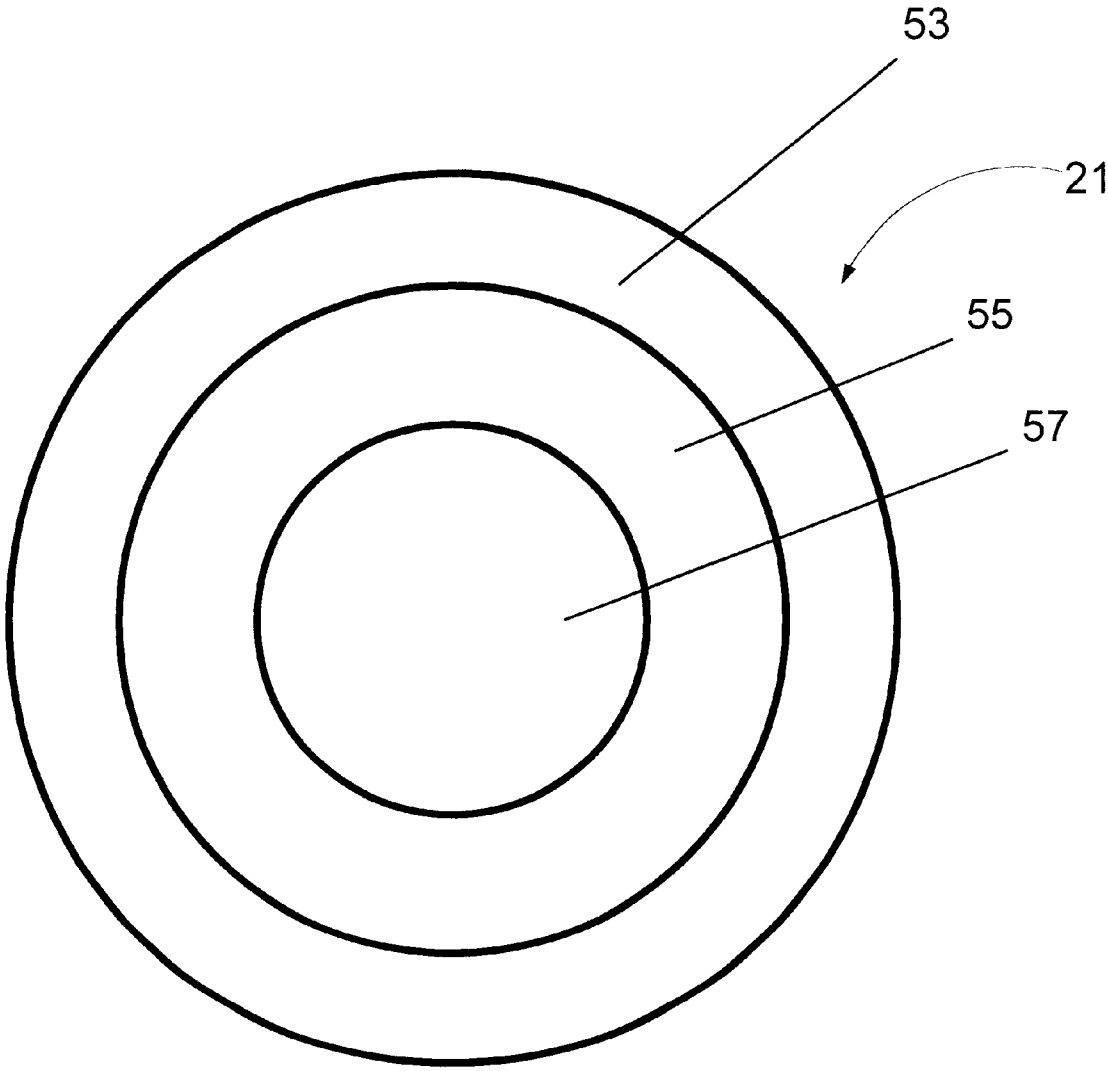
FIG. 9 is a plan view of an alternative embodiment of a processing apparatus that may be used with the present invention.

An alternative technique for selectively adjusting the thickness of a process layer across the surface of the process layer is depicted in FIG. 9. As shown therein, the pedestal 21 has a plurality of thermal bands 53, 55 and 57 formed thereon. Each of the regions 53, 55 and 57 may be separately controlled by a controller (not shown) of the process tool 44. In effect, the thermal bands 53, 55 and 57 are used to locally control the temperature of the wafer upon which the process layer will be formed. For example, if it is desired to form a process layer having a thicker region in the middle area of the wafer, then the heat supplied by thermal band 57 may be increased so as to locally increase the temperature of the wafer 30 and thereby increase the rate of deposition of the process layer in that localized area. Conversely, if it is desired that the edge regions of the process layer have a thickness greater than the thickness of the middle region of the process layer, then the thermal band 53 may be used to locally increase the temperature of the edge regions of the wafer to thereby provide increased deposition rates in that area. In this manner, the thickness of the process layer may be selectively varied across the surface of the wafer 30.

The present invention may also be embodied in a machine or computer readable format, e.g., an appropriately programmed computer, a software program written in any of a variety of programming languages. The software program would be written to carry out various functional operations of the present invention, such as those indicated in FIGS. 4A and 4B, and elsewhere in the specification. Moreover, a machine or computer readable format of the present invention may be embodied in a variety of program storage devices, such as a diskette, a hard disk, a CD, a DVD, a nonvolatile electronic memory, or the like. The software program may be run on a variety of devices, e.g., a processor.

Figure 10:
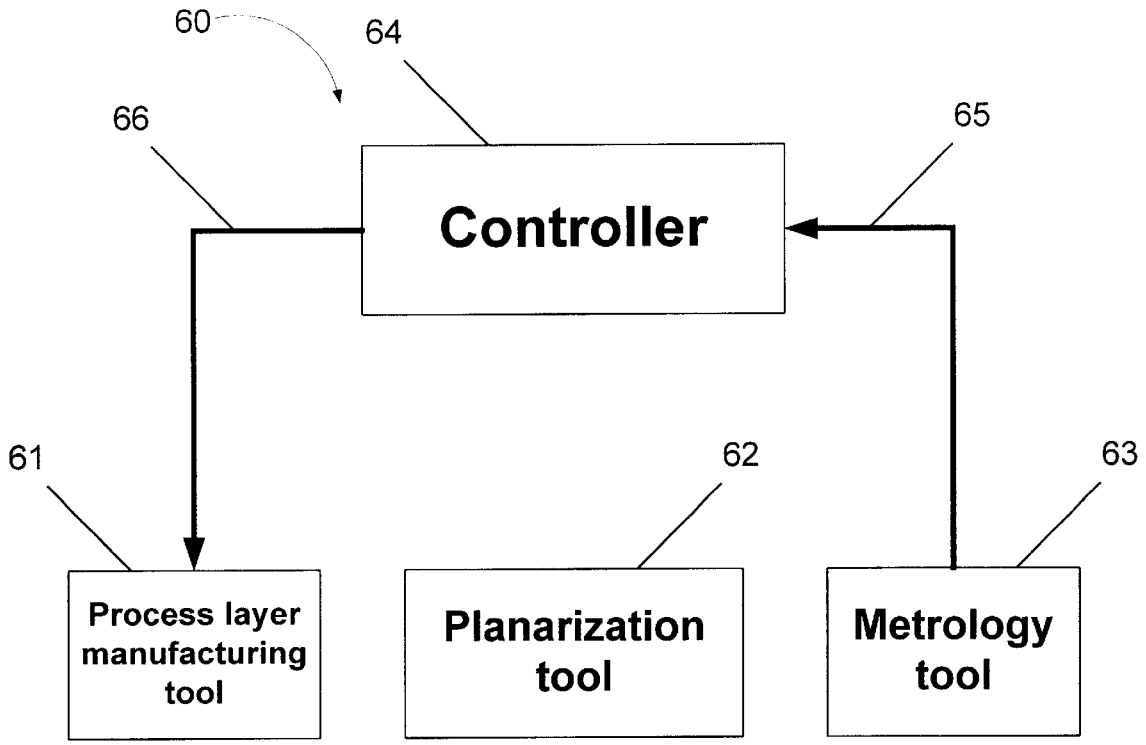
FIG. 10 is an illustrative embodiment of a processing system that may be used with the present invention.

The present invention is also directed to a processing system, e.g., a processing tool or combination of processing tools, for accomplishing the present invention. As shown in FIG. 10, an illustrative system 60 is comprised of a process layer manufacturing tool 61, a planarization tool 62, a metrology tool 63, and a controller 64. In one illustrative process flow, process layers are formed in the process layer manufacturing tool 61, then a surface of the process layer is planarized in the planarization tool 62. Thereafter, measurement of the surface of the process layer after polishing operations may be taken by the metrology tool 63.

The results obtained by the metrology tool 63 are sent to the controller 64 via input line 65. In turn, the controller 64 may send commands to the process layer manufacturing tool 61 to adjust or vary the manufactured thickness of a process layer based upon the polishing profile produced by the planarization tool 62 and/or the thickness variations in a process layer after planarization operations are performed on the process layer by the planarization tool 62.

The process layer manufacturing tool 61 may be any tool used to manufacture process layers encountered in semiconductor fabrication operations. In one illustrative embodiment, the process layer manufacturing tool 61 is a deposition tool, e.g., a CVD chamber, that makes process layers by a deposition process. The planarization tool 62 may be any tool that is used to attempt to produce a planar surface or a process layer after it has been formed. In one illustrative embodiment, the planarization tool 62 is comprised of a chemical mechanical polishing ("CMP") tool. The metrology tool 63 may be any tool that is useful for determining the surface profile of a process layer, or the thickness measurements of a process layer. In one illustrative embodiment, the metrology tool 63 is an Optiprobe® tool manufactured by Thermawave. Moreover, the process layer manufacturing tool 61, planarization tool 72, and metrology tool 63 may be stand-alone units, or they may be combined with one another in a processing tool. For example, the metrology tool 63 may be combined with the planarization tool 62.

The controller 64 may be any type of device that includes logic circuitry for executing instructions. Moreover, the controller 64 depicted in FIG. 10 may be a stand-alone controller or it may be one or more of the controllers already resident on either or both of the process layer manufacturing tool 61, the planarization tool 62, or the metrology tool 63.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method, comprising:

determining a polishing profile produced by a polishing tool; and manufacturing a process layer with a surface profile prior to polishing operations based upon the determined polishing profile of said polishing tool.

2. The method of claim 1, wherein determining a polishing profile produced by a polishing tool comprises determining variations in thickness of a process layer across a surface of said process layer after polishing operations are performed on said process layer by said polishing tool.

3. The method of claim 1, wherein determining a polishing profile produced by a polishing tool comprises determining the extent to which a surface of a process layer deviates from an imaginary planar surface.

4. The method of claim 1, wherein manufacturing said process layer with a surface profile prior to polishing operations based upon the determined polishing profile of said polishing tool comprises manufacturing said process layer with a surface profile that compensates for the polishing profile produced by said polishing tool.

5. The method of claim 1, wherein said polishing profile produced by said polishing tool is comprised of at least one concave region, and manufacturing a process layer comprises manufacturing a process layer with a surface profile comprised of at least one convex region in a location corresponding to said concave region produced by said polishing tool.

6. The method of claim 1, wherein said polishing profile produced by said polishing tool is comprised of at least one convex region, and manufacturing a process layer comprises manufacturing a process layer with a surface profile comprised of at least one concave region in a location corresponding to said convex region produced by said polishing tool.

7. The method of claim 1, wherein determining a polishing profile produced by a polishing tool comprises determining a polishing profile produced by a polishing tool using an ellipsometer.

8. The method of claim 1, wherein manufacturing said process layer comprises depositing said process layer.

9. A method, comprising:

determining a polishing profile produced by a polishing tool, said polishing profile comprised of at least one concave region; and manufacturing a process layer with a surface profile comprised of at least one convex region in a location corresponding to said concave region produced by said polishing tool.

10. The method of claim 9, wherein manufacturing a process layer with a surface profile comprised of at least one convex region in a location corresponding to said concave region produced by said polishing tool comprises manufacturing a process layer with a surface profile comprised of at least one convex region in a location corresponding to said concave region produced by said polishing tool, said manufacturing to be performed by using at least one baffle in a deposition tool to cause different deposition rates of a process layer in different regions.

11. The method of claim 9, wherein manufacturing a process layer with a surface profile comprised of at least one convex region in a location corresponding to said concave region produced by said polishing tool comprises manufacturing a process layer with a surface profile comprised of at least one convex region in a location corresponding to said concave region produced by said polishing tool, said manufacturing to be performed by selectively heating regions of a surface on which a process layer will be formed to different temperatures to cause different rates of deposition of a process layer in said regions.

12. The method of claim 9, wherein manufacturing said process layer comprises depositing said process layer.

13. A method, comprising:

determining a polishing profile produced by a polishing tool, said polishing profile comprised of at least one convex region; and manufacturing a process layer with a surface profile comprised of at least one concave region in a location corresponding to said convex region produced by said polishing tool.

14. The method of claim 13, wherein manufacturing a process layer with a surface profile comprised of at least one concave region in a location corresponding to said convex region produced by said polishing tool comprises manufacturing a process layer with a surface profile comprised of at least one concave region in a location corresponding to said convex region produced by said polishing tool, said manufacturing to be performed by using at least one baffle in a deposition tool to cause different deposition rates of a process layer in different regions.

15. The method of claim 13, wherein manufacturing a process layer with a surface profile comprised of at least one concave region in a location corresponding to said convex region produced by said polishing tool comprises manufacturing a process layer with a surface profile comprised of at least one concave region in a location corresponding to said convex region produced by said polishing tool, said manufacturing to be performed by selectively heating regions of a surface on which a process layer will be formed to different temperatures to cause different rates of deposition of a process layer in said regions.

16. The method of claim 13, wherein manufacturing said process layer comprises depositing said process layer.

17. A computer-readable, program storage device encoded with instructions that, when executed by a computer, perform a method comprising:

determining a polishing profile produced by a polishing tool; and manufacturing a process layer with a surface profile prior to polishing operations based upon the determined polishing profile of said polishing tool.

18. A method, comprising:

determining a polishing profile produced by a polishing tool; and depositing a process layer with a surface profile that compensates for the polishing profile produced by said polishing tool.

19. The method of claim 18, wherein said deposition of said process layer is performed by using at least one baffle in a deposition tool to cause different deposition rates of said process layer in different regions.

20. The method of claim 18, wherein said deposition of said process layer is performed by selectively heating regions of a surface on which a process layer will be formed to different temperatures to cause different rates of deposition of said process layer in different regions.

21. The method of claim 18, wherein said determined polishing profile is comprised of at least one concave region and wherein said process layer is deposited with a surface profile comprised of at least one convex region corresponding to said concave region of said polishing profile.

22. The method of claim 18, wherein said determined polishing profile is comprised of at least one convex region and wherein said process layer is deposited with a surface profile comprised of at least one concave region corresponding to said convex region of said polishing profile.

* * * * *